US008214995B2

(12) United States Patent
Yrjölä

(10) Patent No.: US 8,214,995 B2
(45) Date of Patent: Jul. 10, 2012

(54) METHOD AND TOOL FOR MANUFACTURING OF BUILD UP PRODUCTS

(75) Inventor: Tomi Yrjölä, Gislaved (SE)

(73) Assignee: Multicomp AB, Gislaved (SE)

( * ) Notice: Subject to any disclaimer, the term of this patent is extended or adjusted under 35 U.S.C. 154(b) by 855 days.

(21) Appl. No.: 12/278,429

(22) PCT Filed: Oct. 4, 2006

(86) PCT No.: PCT/SE2006/001125

§ 371 (c)(1),
(2), (4) Date: Aug. 6, 2008

(87) PCT Pub. No.: WO2007/094710

PCT Pub. Date: Aug. 23, 2007

(65) Prior Publication Data

US 2008/0307628 A1 Dec. 18, 2008

(30) Foreign Application Priority Data

Feb. 14, 2006 (SE) ..... 0600330

(51) Int. Cl.
*B23P 21/00* (2006.01)
*B23P 11/00* (2006.01)

(52) U.S. Cl. ..... 29/430; 29/429; 29/771; 29/787; 29/788; 29/790

(58) Field of Classification Search ..... 29/429, 29/430, 771, 787, 788, 789, 790; 413/3
See application file for complete search history.

(56) References Cited

U.S. PATENT DOCUMENTS 3,172,198 A * 3/1965 Rulf ..... 29/416
3,452,695 A 7/1969 Anthony
3,510,933 A * 5/1970 Taylor et al. ..... 29/417

(Continued)

FOREIGN PATENT DOCUMENTS

DE 19535759 A1 4/1997

OTHER PUBLICATIONS

International Search Report for corresponding International Application PCT/SE2006/001125.

(Continued)

*Primary Examiner* — Essama Omgba
(74) *Attorney, Agent, or Firm* — WRB-IP LLP

(57) ABSTRACT

A tool for producing composite objects, including a first and a second material path, along which a first and second sheet material are stepwise feedable. Along the first and second material paths there are disposed a number of processing stations for processing the first and second sheet materials by shearing, punching, pressing, bending etc. The first and second material paths intersect one another and in the zone of intersection an assembly station is disposed for joining together or assembling component parts from the first and second material paths. A method of producing from sheet material a composite object includes the steps of stepwise feeding a first sheet material in a first feeding direction, the sheet material being processed between certain feeding steps, feeding a second sheet material stepwise in a second feeding direction, the second sheet material being processed between certain feeding steps. The first and second component parts are assembled together and caused to leave the tool in the assembled state.

20 Claims, 4 Drawing Sheets

U.S. PATENT DOCUMENTS

| | | | | |
|---|---|---|---|---|
| 3,588,990 | A * | 6/1971 | Klaus et al. | 29/412 |
| 3,766,626 | A * | 10/1973 | Mjos et al. | 29/34 R |
| 4,722,653 | A * | 2/1988 | Williams et al. | 414/222.13 |
| 4,856,701 | A * | 8/1989 | Pockl | 228/6.1 |
| 5,016,506 | A | 5/1991 | Bulso et al. | |
| 5,161,302 | A * | 11/1992 | Mueller | 29/773 |
| 5,249,902 | A * | 10/1993 | Stankiewicz | 412/7 |
| 5,325,578 | A * | 7/1994 | Oetiker | 29/429 |
| 6,742,245 | B2 * | 6/2004 | Glenn | 29/787 |
| 6,865,800 | B2 * | 3/2005 | Utecht et al. | 29/711 |
| 7,730,608 | B2 * | 6/2010 | Kvalheim | 29/771 |
| 7,823,272 | B2 * | 11/2010 | Guay et al. | 29/820 |
| 2002/0056189 | A1 * | 5/2002 | Oatridge et al. | 29/771 |
| 2004/0194275 | A1 * | 10/2004 | Kummle | 29/430 |
| 2011/0010929 | A1 * | 1/2011 | Guay et al. | 29/705 |

OTHER PUBLICATIONS

International Preliminary Report on Patentability for corresponding International Application PCT/SE2006/001125.

* cited by examiner

METHOD AND TOOL FOR MANUFACTURING OF BUILD UP PRODUCTS

BACKGROUND AND SUMMARY

The present invention relates to a method of producing from sheet material a composite object comprising the steps: that a first sheet material is fed stepwise in a first feeding direction of a first feeding length through a tool from a first infeed section to a discharge section, the first sheet material being, at least between certain feeding steps, processed by shearing, punching, pressing, bending, etc.

The present invention also relates to a tool for producing from sheet material a composite object and comprises: a first material path, extending through the tool and along which a first sheet material is stepwise feedable, of a first feeding length, the first material path displaying a number of processing stations for processing the first sheet material by shearing, punching, pressing, bending, etc.

In the manufacture of composite objects, i.e. objects which consist of at least two but possibly more component parts, taking as a point of departure sheet material, it has previously been the practice to manufacture, in a first tool, a first component part which is in principle completely finished. Besides, in a second, possibly third or fourth tool, a second or possibly a third or fourth component part has been produced. The thus produced component parts have subsequently been joined together to produce the finished object. As regards this joining together or assembly, various techniques have been employed, for example riveting, screwing, welding, seaming and possibly also gluing.

In the production of the component parts included in the object, these have as a rule been handled in bulk. This implies that the assembly and joining together of the component parts after their production has afforded major problems in automation and machine execution. The problems that in such instance are encountered are the picking of component parts from a bulk stock, their specific orientation, as well as positioning of the oriented component parts. In certain cases, for example when the component parts show a tendency to catch in one another, it has hardly been possible to carry out the above-mentioned orientation and positioning at all.

While, in certain contexts, it has been possible to automate the assembly of the component parts, such automation has required large and expensive machinery. From this it follows that assembly and joining together of the component parts is often carried out manually, and often in cheap labour countries.

In manual assembly, despite the utilisation of a workforce from these cheap labour countries, such costs have often proved to be at a high level because of transport costs, more or less defective precision and resultant poor quality and a high percentage of rejects.

The present invention has for its object to obviate the prior art problems. In particular, the present invention has for its object to design the method intimated by way of introduction such that, in one and the same tool, it is possible to manufacture a composite object up to the completely finished state or at least so far that the component parts included in the composite object are joined together. The present invention further has for its object to design the method such that productivity will be high, precision good and costs low, even in moderately large series. Finally, the present invention has for its object to design the method such that manufacture of the component parts included in the composite object may take place wholly independently of one another right up to the moment when they are assembled.

The present invention further has for its object to design the tool intimated by way of introduction such that this offers the same or analogous qualities compared with the method according to the invention.

The objects forming the basis of the present invention will be attained in respect of the method, if this is characterised in that at least a second sheet material is fed through a second feeding section stepwise into the tool in a second feeding direction, and of a second feeding length, that the second sheet material, at least between certain feeding steps, is processed into wholly or partly finished second component parts of the object by shearing, punching, pressing, bending etc., that the second component parts in the tool are joined together with the first component parts to form the object, wholly or partly finished from the first sheet material, and are caused to leave the tool in the assembled state in the first feeding direction.

Given that the joining together of the two component parts takes place in one and the same tool, both orientation and positioning of the component parts is simple, since these are defined by the tool, The objects forming the basis of the present invention will be attained in respect of the tool, if this is characterised by at least a second material path along which a second sheet material is stepwise feedable, of a second feeding length, there being disposed along the second material path a number of processing stations for processing the second sheet material by shearing, punching, pressing, bending etc., a station for joining together or assembling wholly or partly finished first component parts produced from the first sheet material with wholly or partly finished second component parts produced from the second sheet material being disposed in a zone of intersection between the first and the second material paths.

By means of these characterising features in respect of the tool, advantages will be afforded which are totally analogous with those advantages that are attained by the design of the

BRIEF DESCRIPTION OF THE ACCOMPANYING DRAWINGS

The present invention will now be described in greater detail hereinbelow with particular reference to the accompanying Drawings. In the accompanying Drawings.

DETAILED DESCRIPTION

Figure 1:
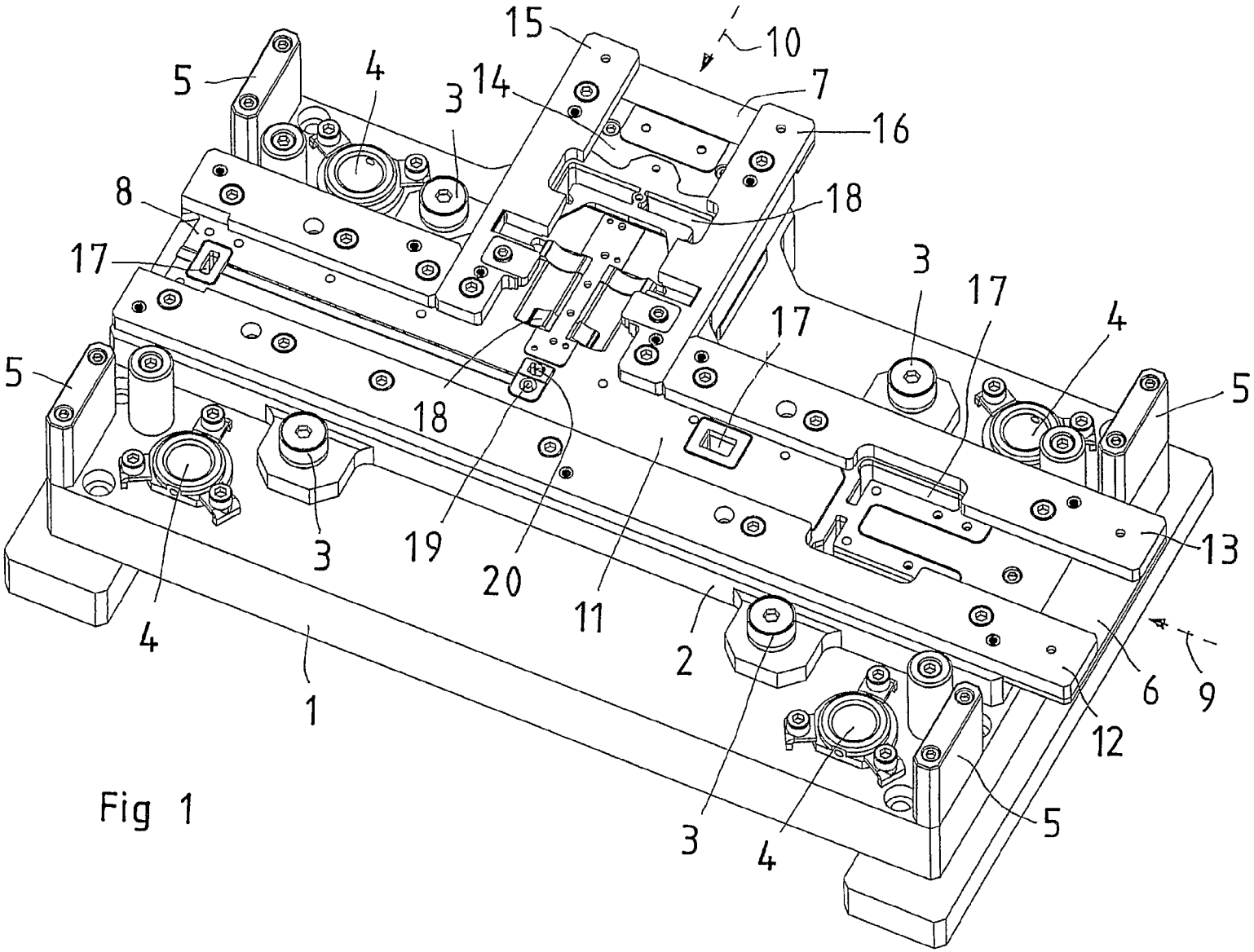
FIG. 1 is a perspective view of a lower part included in a complete tool without any workpieces.

The present invention will now be described for purposes of exemplification with reference to a given tool, but since the type of manufactured object may vary widely, it will readily be perceived that the exact formation and design of the tool may vary greatly from one situation to another depending on the design and construction of the manufactured object.

The invention will be exemplified as applied in a vertically operating press. However, in certain cases the working direction of the press may be horizontal, without this circumstance in any way affecting the principles of the present invention.

A press of the type which is intended for practical application of the present invention has a lower clamping table on which a lower tool half or part may be clamped. The press has a press slide which is reciprocally movable in relation to the clamping table and on which an upper tool half or part may be mounted. In one working stroke of the press, the press slide is moved in a downward direction towards the clamping table a certain distance until one working stroke is completed, whereafter the press slide is once again raised.

A tool for carrying the present invention into effect has a lower base plate 1 by means of which the lower part of the tool is secured on the clamping table. The lower tool part further has a lifting plate 2 which is movable in the vertical direction in relation to the base plate. The lifting plate is spring-biased in an upward direction and can thus, during one working stroke, be pressed a certain distance downwards towards the base plate. The lifting plate serves for supporting the often band-shaped sheet material which is the object of processing in the tool.

The base plate 1 has fixedly mounted dies 26, 27 and similar processing components which, when the lifting plate is pressed downwards, come into abutment with the underside of the workpiece so that processing of the workpiece may take place.

The upper part of the tool (shown only in FIG. 3) has an upper fixing plate 23 which is intended for mounting on the press slide. Further, the upper part of the tool has a retainer plate or sheet retainer plate 24 which is movable in the vertical direction in relation to the fixing, plate. The retainer plate is spring-biased in the downward direction but can be pressed upwards against the spring action during a working stroke.

The retainer plate 24 is intended to come into abutment with the upper side of the workpiece during a working stroke in order to hold the workpiece in position but also, in certain situations, to prevent buckling, folding or the like in the workpiece.

On the underside of the upper fixing plate, there are disposed punching, pressing, shearing tools and the like which, during a working stroke, pass through corresponding openings in the retainer plate 24 in order to cooperate with dies 26, 27, shearing tools or the like disposed on the base plate 1.

During a working stoke, the upper tool part is lowered until the retainer plate 24 comes into contact with the upper face of the workpiece. Thereafter, the retainer plate and the lifting plate 2 will, as a rigid unit, be forced downwards together so that processing of the workpiece located between them will take place. The scrap which may possibly be separated in this operation leaves the tool at least partly under the action of forces of gravity in a downward direction.

After completed processing of the workpiece, the upper tool part is raised, whereafter the lifting plate 2 and the retainer plate 24 and the workpiece lying between them are lifted to the starting position, whereafter the upper tool part continues to be lifted so that the lifting plate comes to a distance from the lower tool part and the workpieces or workpiece located therein.

FIG. 1 shows in perspective obliquely from above a lower part of a tool for carrying the present invention into effect, m the Figure, reference numeral 1 relates to a base plate (the base plate of the tool) and reference numeral 2 to a lifting plate. In such instance, as was mentioned above, the base plate 1 is intended to be secured on a clamping table in a press.

The lifting plate 2 is, as was mentioned above, movable in a vertical direction in relation to the base plate 1 and is, in the height direction, movably guided in relation to the base plate by means of guides 3. While not being apparent from the Figure, there is a space in the vertical direction between the underside of the lifting plate 2 and the underside of the base plate 1.

Further, the lifting plate 2 is spring-biased in an upward direction, i.e. away from the base plate 1.

The base plate 1 further displays guides 4 in which are accommodated corresponding guides on an upper part (not shown in the Figure) of the tool. The purpose of the guides 4 and the corresponding guides on the upper part of the tool is, during a working stroke, to accurately guide the upper part of the tool and the lower part of the tool in relation to one another in the transverse direction (transversely of the direction of movement of the press).

Further, the base plate 1 has upwardly directed arrest means 5 which are intended to enter into abutment with corresponding arrest means disposed on an upper fixing plate in the upper part of the tool in order thereby to restrict the relative displacement of the upper part of the tool and its lower part in relation to one another.

The lifting plate 2 has at least a first infeed section 6 and a second infeed section 7, as well as a discharge section 8. From the first infeed section 6 to the discharge section 8, there extends a first feeding direction 9. A second feeding direction 10 extends from the second infeed section 7 in towards the first feeding direction, and so the second feeding direction is transversely directed in relation to the first. The second feeding direction makes all angle with the first, where the angle may vary within broad limits and may possibly be a right angle. In FIG. 1, the first feeding direction is intimated by the broken line arrow 9 and the second feeding direction by the broken line arrow 10. It is apparent with all desirable clarity that the two feeding directions 9 and 10 intersect one another.

The sheet material, as a rule band-shaped, which is fed to the first infeed section 6 and the second infeed section 7, is advanced stepwise by a first feeder mechanism and a second feeder mechanism, respectively. These two feeder mechanisms are wholly independent of one another apart from in one respect, namely that a feeding step may take place only when the tool is open. The feeding movements that are carried out will therefore take place synchronously. However, it is fully possible that the second feeder mechanism is idling when the first feeder mechanism executes one or more feeding steps and vice versa. It should also be observed that the feeding length of the feeder mechanisms may be selected to be totally independent of one another.

Along the first feeding direction 9, there is disposed a first material path 11 which is defined by or limited by two guides 12 and 13 disposed along the feeding direction 9. The purpose of the guides 12 and 13 is to guide through the tool a first sheet material, which as a rule is strip- or band-shaped, so that this follows the first material path in a stepwise feeding through the tool.

Along the second feeding direction 10, the tool has a second material path 14 which is also defined by guides 15 and 16 whose purpose is to guide a second sheet material, most generally in the form of a strip or band, along the second feeding direction 10 and along the second material path 14. The first and the second material paths are disposed together as a rigid unit mounted on a common plate.

The width of the two material paths 11 and 14 may be selected to be totally independent of one another, and depends entirely on the appearance of the object being manufactured.

Along the first material path 11, there are disposed a number of processing stations 17 for processing the first sheet material, for example by shearing, punching, pressing, bending, seaming, hole-making etc. In principle, the processing stations may be designed to execute all of the working operations which can be carried out in a tool of the type described here.

Exactly where the processing stations 17 are located, how many they are in number and what working duties they are designed to carry out depend on the type of object which the tool is to manufacture. Thus, major variations are possible.

In analogy with the first material path 11, the second material path 14 also has a number of processing stations 18 for processing the second sheet material at least between certain of the feeding steps which the second sheet material undergoes during operation.

Also as regards the second material path 14, both the positioning, number and design of the processing stations may vary considerably and are wholly dependent on the type of processing that is to be carried out on the second sheet material.

The number of processing stations 17 and 18 along both of the material paths 11 and 14, respectively need not be equal, but is selected in dependence on the construction of the object to be manufactured, in particular the construction of the component parts which together form the composite object.

In the zone of intersection between the first and the second feeding directions 9 and 10, respectively, but also in the zone of intersection between the first and the second material paths 11 and 14, respectively, there is disposed an assembly or joining station 19 which is designed at least partly to assemble component parts produced in the first material path with component parts produced in the second material path. In this instance, it is sufficient that the two component parts are assembled or joined enough for their mutual positions not to be deranged when they are fed further along the first material path 11.

In addition, there is disposed in the zone of intersection between the two material paths 11 and 14 a separator device 20 whose purpose is to separate one component part produced along the second material path from the immediately following component part along the second material path so that the separated component part may continue to move along the first feeding direction 9 without being prevented by the second sheet material or component parts produced therefrom.

Figure 2:
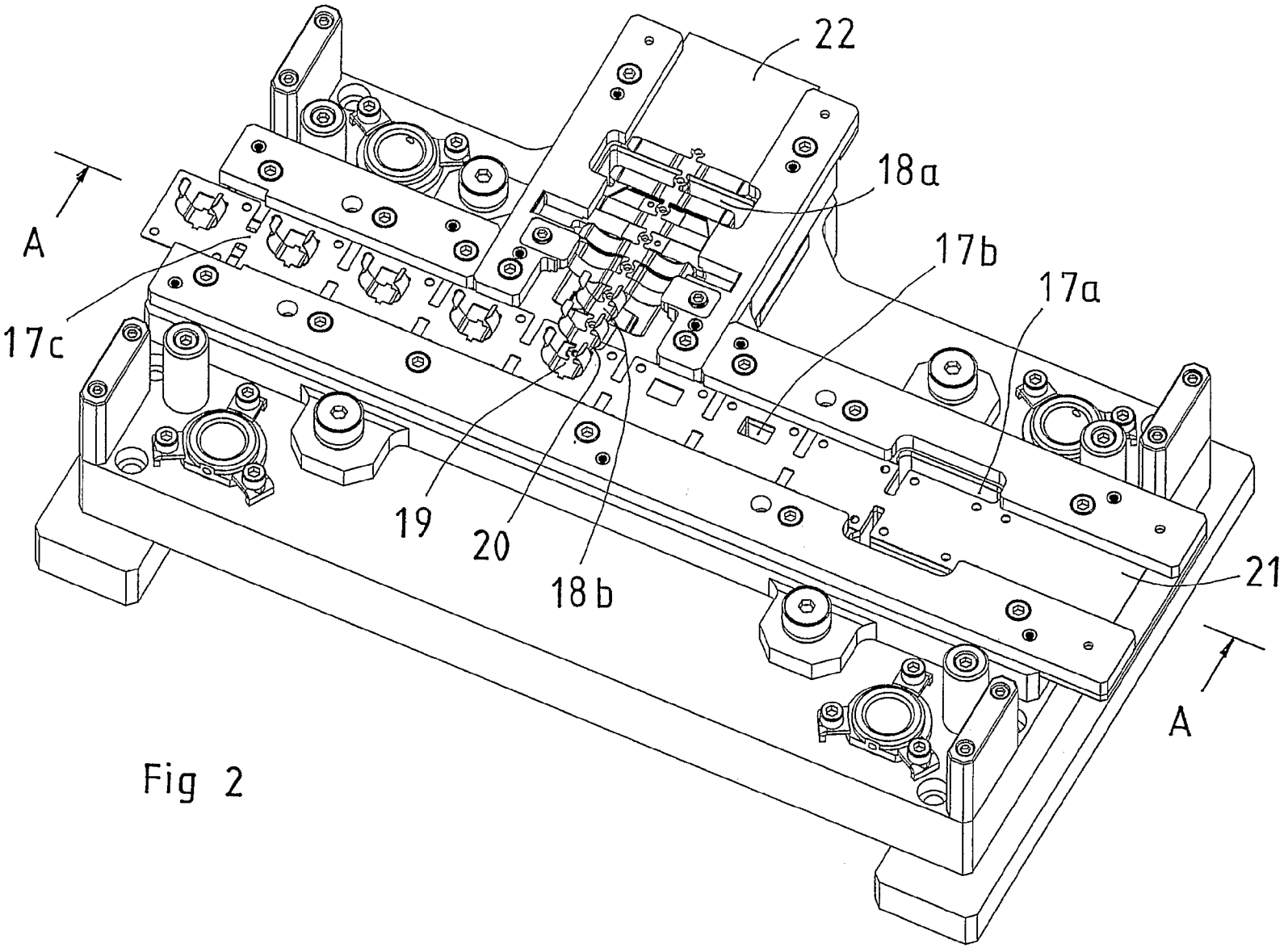
FIG. 2 shows the tool part according to FIG. 1 now with workpieces placed therein.
Figure 4:
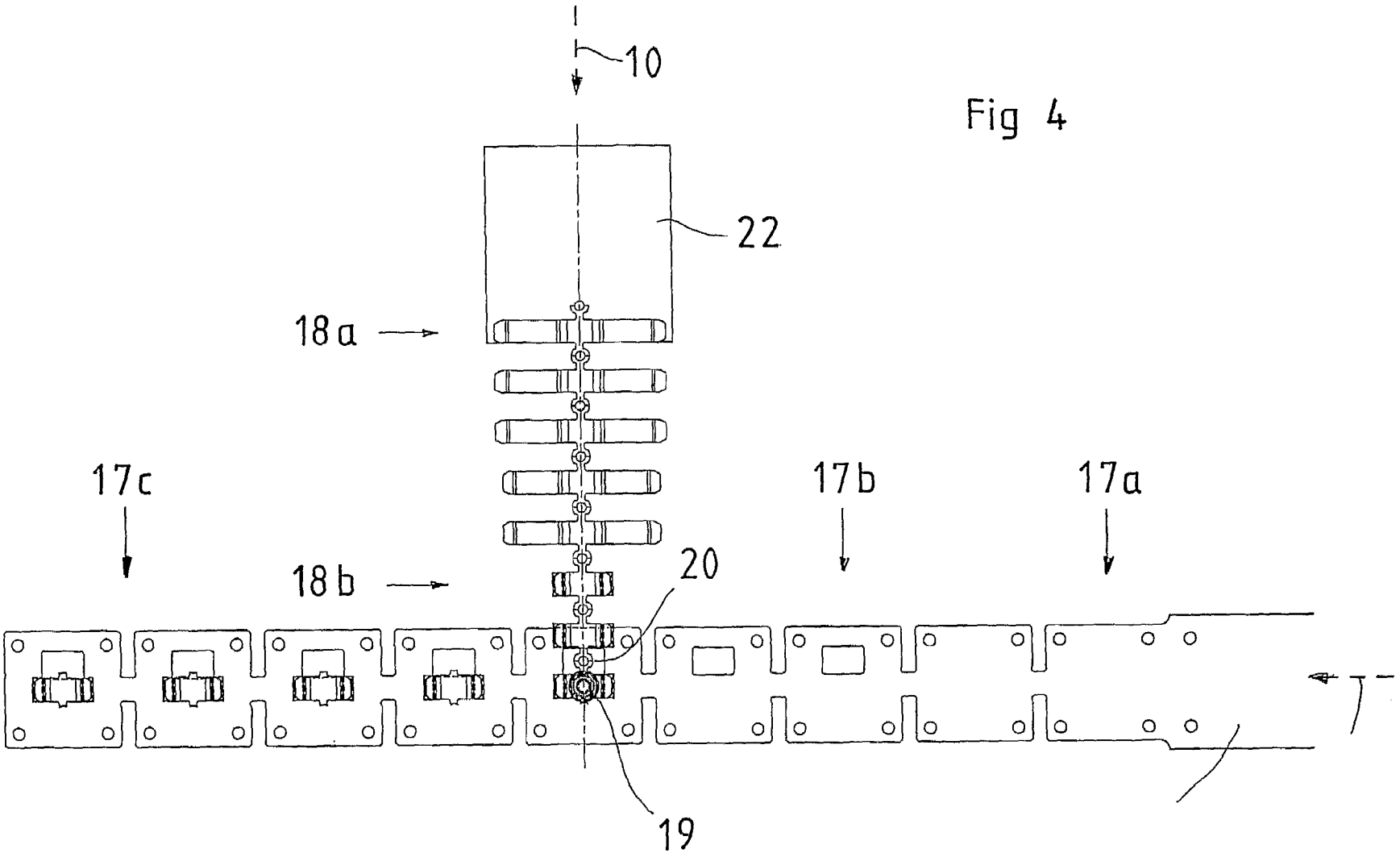
FIG. 4 is atop plan view of the workpieces illustrated in FIG. 2.

FIG. 2 is a perspective view corresponding to FIG. 1, but both the first sheet material and the second sheet material are in place in the tool, as well as component parts produced from them. FIG. 4 shows separately, straight from above, the two sheet materials.

It will be apparent from FIGS. 2 and 4 taken together that a first sheet material in the form of a band 21 is disposed on the first material path 11 and that a second sheet material in the form of a band 22 is disposed on the second material path 14. It will further be apparent from FIG. 4 that both of the sheet material bands 21 and 22 are disposed to move stepwise in the first feeding direction 9 and in the second feeding direction 10, respectively.

In FIG. 2, that processing station which is located furthest to the right in FIG. 1 and which is to be considered as the first processing station has been given reference numeral 17*a*.

Correspondingly, the subsequent processing station in the feeding direction 9 illustrated in FIG. 1 has been given reference numeral 17*b* and the last processing station in the feeding direction has been given reference numeral 17*c*. Corresponding reference numerals have been inserted in FIG. 4.

It will be apparent from FIGS. 2 and 4 taken together that, in processing station 17*a*, the contour for a plate is cut out of the band 21 at the same time as holes are made in the plate, and the holes may serve the purpose of acting as assembly holes for the object produced in the tool, but may also function as guides for positional determination of the first band 21 in the tool by cooperation with guide pins provided in the tool.

In processing station 17*b*, a rectangular hole is made in the plate cut out in processing station 17*a*. Finally, in processing station 17*c*, the finished object is separated from more or less finished objects lying behind.

In analogy with that disclosed above, the processing stations in FIGS. 2 and 4 along the second material path 14 have been given reference numerals 18*a* and 18*b*. It will be apparent from FIG. 4 that, in processing station 18*a*, a blank is cut out of the second sheet material band 22, the blank then, in a subsequent processing station 18*b*, being formed into a spring clip which is shown in perspective in FIG. 2 and is shown straight from above in FIG. 4.

As was intimated above, in the zone of intersection between the two sheet bands 21 and 22, there is disposed the assembly station 19. Further, the separator device 20 has been marked in both FIG. 2 and in FIG. 4.

The above-described working steps and the appearance of the component parts that have been produced on the basis of the two sheet material bands 21 and 22 may vary considerably and are completely dependent on the type of object which is to be manufactured in the tool.

It will be apparent from FIG. 2 that the second sheet material band 22, when entering the zone of intersection with the first sheet material band 21, and in particular those component parts which have been produced from the second sheet material band will arrive on the upper side of the first sheet material band 21. Alternatively, it may also possibly be conceivable to cause component parts produced from the second sheet material band 22 to arrive on the underside of the first sheet material band 21 or component parts produced therefrom. For this reason, the height level in the tool of the first infeed section 6 and the second infeed section 7 differ. The difference in height level corresponds to the material thicknesses of the two sheet bands 21 and 22. In the alternative involving the second sheet band 22 lying uppermost, the height difference corresponds to the material thickness of the first sheet band. The corresponding applies such that, when the second sheet band 22 lies under the first sheet band 21, the height difference corresponds to the material thickness of the second sheet band 22.

It should be mentioned and emphasised that it is entirely possible that the material thicknesses of the two sheet bands can vary within considerable limits and they may naturally also have different values between them. It is also possible that the material in both of the sheet bands 21 and 22 may consist of or comprise completely different materials and also of different qualities of one and the same basic type of material. Thus, it is fully possible that the first sheet band 21 consists of or comprise steel while the second sheet band 22 consists of or comprises aluminium, or vice versa. Further, the width of the two sheet bands 21 and 22 may differ considerably. Finally, as was mentioned above, the feeding length may also vary between the sheet bands.

The assembly station or device 19 shown in the Drawings is designed for realising assembly by means of riveting. However, according to the present invention, it is equally expedient to use an assembly station which operates by welding, screw union, seaming or uses any other joining process.

Figure 3:
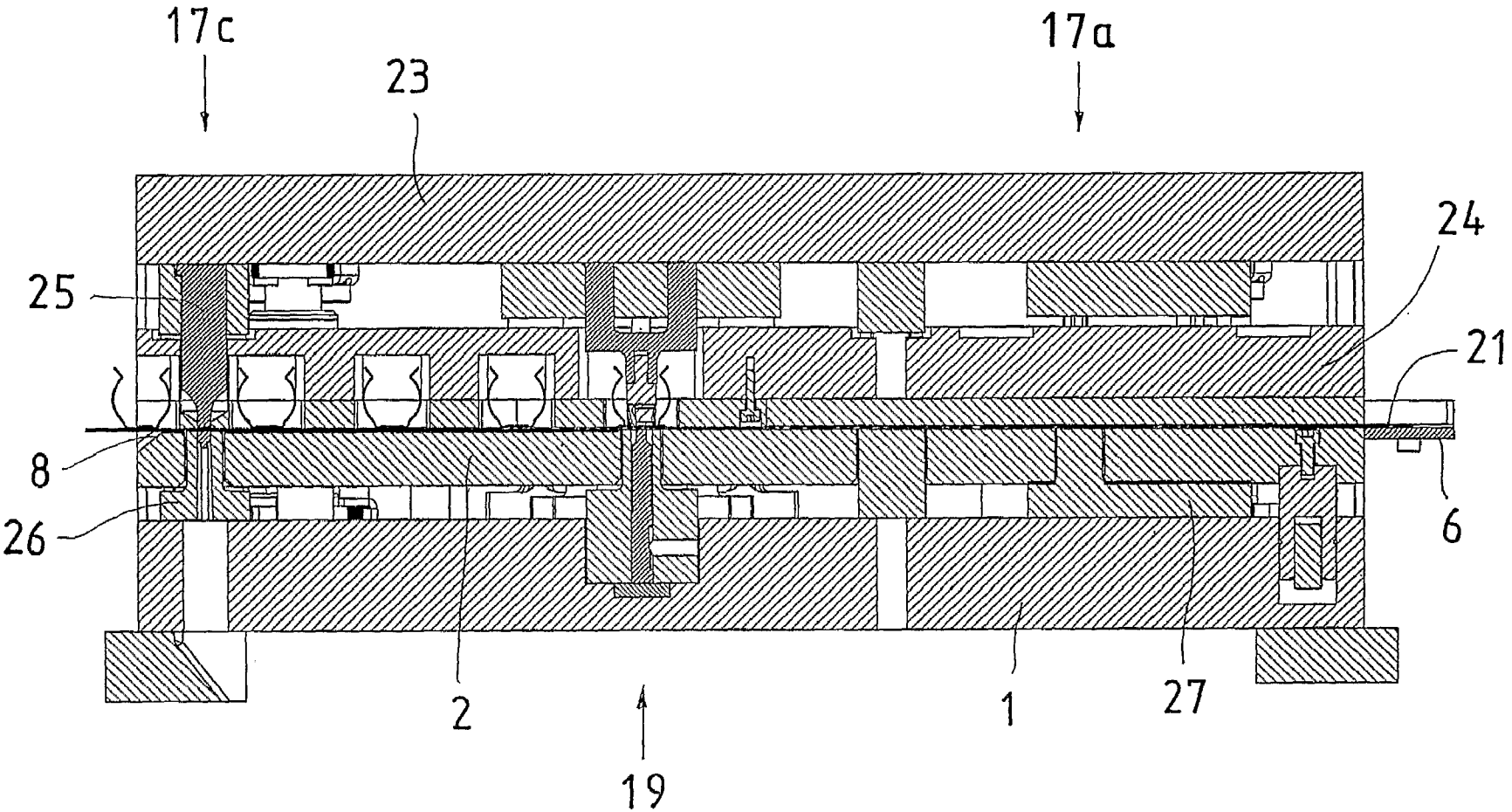
FIG. 3 is a section taken through a complete tool in the closed state, comprising the tool parts 1 and 2 and provided with workpieces.

FIG. 3 shows a vertical cross section through the complete tool during a working stroke, taken along the section line A-A in FIG. 2. In FIG. 3, the reference numerals in accordance with the foregoing Figures have been marked. In addition, the upper fixing plate of the tool has been given reference numeral 23, while its retainer plate or sheet retainer plate has been given reference numeral 24. It should be pointed out that the retainer plate 24 is produced from an upper plate section and a lower plate section which are joined together by screw union to form a rigid unit.

Furthest to the left in FIG. 3 is shown a punch 25 which is lowered down into a corresponding die 26, in which event the punch and the die constitute that processing station which, in FIGS. 2 and 4, was given reference numeral 17*c*. Furthermore, a die 27 for a shearing tool is intimated at processing station 17*a* as being included in this processing station.

On operation of the above-described tool, a first sheet material, as a rule in strip- or band form, for example the sheet material band 21, is fed into the tool via a first infeed section 6 of a first feeding length, and along a first feeding direction 9 to a discharge section 8 at the opposing end of the tool. The feeding along the feeding direction 9 takes place stepwise when the tool is open. At least between certain feeding steps along the feeding direction 9, the first sheet material is processed by shearing, punching, pressing, bending etc. according to requirements as dictated by the form of the object which is in the process of being manufactured in the tool.

A second sheet material, most generally in the form of strip or sheet band 22, is fed via a second infeed section 7 of a second feeding length into the tool along a second feeding direction 10. The feeding along the feeding direction 10 also takes place stepwise and also here processing takes place of the second sheet band 22 at least between certain feeding steps along the feeding direction 10.

The first and the second feeding lengths may be the same, but may also differ to a considerable extent.

According to the present invention, it is also possible to feed in a third or more sheet material bands in corresponding feeding directions which intersect the first feeding direction 9.

When the second sheet band 22 has reached a zone of intersection between the first feeding direction 9 and the second feeding direction 10, an assembly or joining together takes place of such component parts of the finished object as were manufactured starting from the first sheet material band 21 with such component parts as were manufactured starting from the second sheet material band 22. Thereafter, the object composed of the component parts is fed further from the joining or assembly zone along the first feeding direction 9 and out together through the discharge section 8. Further processing of the object composed from the component parts may take place in the tool between the assembly or joining zone and the discharge section.

As a rule, component parts produced from the two sheet bands 21 and 22 will be placed one on top of the other. For this reason, the sheet bands are fed along different height levels through the tool, where the difference between these sheet levels corresponds to the material thickness of the sheet band located lowermost.

Immediately before the assembly or joining zone, that component part which is located in the joining zone is separated from the component part located behind it so that the latter component part does not prevent further feeding of the former component part in the first feeding direction 9 away from the assembly or joining zone in a direction towards the discharge section 8.

The processing of the two sheet material bands 21 and 22 takes place with synchronous movements in the tool, since the processing stations 17 and 18 are disposed on a plate which is formed into a rigid unit and which may possibly be composed of smaller plates.

In the foregoing, it has been described how the two material pieces which form the basis of manufacture according to the present invention are intended to be sheet material. Naturally, this term includes any type of sheet material, regardless of its physical make-up, material thickness and width. In one practical embodiment, the term sheet material is in most cases likely to be construed as band or strip-shaped steel sheet. However, the term also encompasses other metals and metal alloys, such as aluminium, brass, copper, stainless steel, titanium etc. it should further be emphasised that the material properties in the processed material workpieces may vary considerably so that the one material band may consist, for instance, of or comprise spring steel, while the other material band consists of or comprises a considerably softer and plastically deformable material. In certain situations, plastics materials are also conceivable as constituting one of the material workpieces processed according to the present invention.

The above-described tool has a first and second infeed section 6 and 7, respectively. According to the present invention however, it is possible to use additional infeed sections, additional feeding directions and additional material paths so that the finished product may be composed from at least two, but also three or more component parts which are produced each from its material piece, where each material piece is fed via its own infeed section. In the situation involving three or more infeed sections, feeding directions and material paths, the construction is totally analogous with the above-described situation involving two infeed sections, etc.

What is claimed is:

1. A method of producing from sheet material a composite object comprising the steps:

feeding a first sheet material stepwise in a first feeding direction of a first material path of a first feeding length through a tool from a first infeed section to a discharge section, the first feeding direction being defined by two first sheet material path guides mounted on a plate, the first sheet material being, at least between certain feeding steps, processed at one or more first sheet material processing stations, feeding at least a second sheet material through a second feeding section stepwise into the tool in a second feeding direction of a second material path of a second feeding length, the second feeding direction being defined by two second sheet material path guides mounted on the plate, the second sheet material, at least between certain feeding steps, being processed into wholly or partly finished second component parts of the object at one or more second sheet material processing stations, the first and second feeding directions being different, and joining the second component parts in the tool together with the first component parts of the object, wholly or partly finished from the first sheet material, and causing the joined first and second components to leave the tool in the assembled state in the first feeding direction.

2. The method as claimed in claim 1, wherein the second feeding direction is caused to intersect the first feeding direction.

3. The method as claimed in claim 2, wherein at least an initial stage of the assembling operation is carried out in a zone of intersection between the first feeding direction and the second feeding direction.

4. The method as claimed in claim 1, wherein the second sheet material is fed to the tool on a higher or lower height level than the height level of the first sheet material, and where the difference in height level corresponds to the material thickness in the first and second sheet material, respectively.

5. The method as claimed in claim 1, wherein the second component part is separated from an immediately subsequent second component part in the second feeding direction, at the same time as at least one initial stage of the assembling operation with the first component part is carried out.

6. The method as claimed in claim 1, wherein the first sheet material and the second sheet material are given different material thicknesses.

7. The method as claimed in claim 1, wherein the first sheet material and the second sheet material are given different material compositions or properties.

8. The method as claimed in claim 1, wherein the processing of the first and the second sheet materials is carried out with synchronous movements.

9. The method as claimed in claim 1, wherein the processing of the first and the second sheet materials as well as the assembling of the first and the second component parts are carried out with synchronous movements.

10. The method as claimed in claim 1, wherein the first sheet material is processed by at least one of shearing, punching, pressing, and bending.

11. The method as claimed in claim 1, wherein the second sheet material is processed by at least one of shearing, punching, pressing, and bending.

12. The method as claimed in claim 1, wherein the first and second material processing stations are mounted on the plate.

13. A tool for producing from sheet material composite objects, comprising:

a first material path, extending through the tool and along which a first sheet material is stepwise feedable, the first material path being of a first feeding length and extending in a first feeding direction defined by two first sheet material path guides mounted on a plate, the first material path displaying a number of first material processing stations for processing the first sheet material, at least a second material path along which a second sheet material is stepwise feedable, the second material path being of a second feeding length and extending in a second feeding direction different than the first feeding direction and defined by two second sheet material path guides mounted on the plate, there being disposed along the second material path a number of second material processing stations for processing the second sheet material, and a station for joining together or assembling wholly or partly finished first component parts of the object produced from the first sheet material with wholly or partly finished second component parts of the object produced from the second sheet material being disposed in a zone of intersection between the first and the second material paths.

14. The tool as claimed in claim 13, wherein the first and the second material paths are disposed together as a rigid unit.

15. The tool as claimed in claim 13, wherein the first material path has a first infeed section and a discharge section, that the second material path has a second infeed section and that the second material path is disposed intersecting the first.

16. The tool as claimed in claim 15, wherein the second infeed section is disposed on a higher or lower height level than the first infeed section, the difference in height level corresponding to the thickness of the first and the second sheet materials, respectively.

17. The tool as claimed in claim 13, wherein the station for assembling includes means for riveting, screwing, welding or seaming.

18. The tool as claimed in claim 13, wherein the processing stations are adapted to process the first sheet material by at least one of shearing, punching, pressing, and bending.

19. The tool as claimed in claim 13, wherein the processing stations are adapted to process the second sheet material by at least one of shearing, punching, pressing, and bending.

20. The tool as claimed in claim 13, wherein the first and second material processing stations are mounted on the plate.

* * * * *